US006463601B1

(12) United States Patent
Fetty

(10) Patent No.: US 6,463,601 B1
(45) Date of Patent: Oct. 15, 2002

(54) SELF-CONTAINED WASTE AND REFUSE DISPOSAL UNIT

(75) Inventor: Randy E. Fetty, P.O. Box 144, Milton, WV (US) 25541

(73) Assignees: Randy E. Fetty, Milton, WV (US); Matt Moran, Vernon, NY (US)

( * ) Notice: Subject to any disclaimer, the term of this patent is extended or adjusted under 35 U.S.C. 154(b) by 0 days.

(21) Appl. No.: 08/976,812

(22) Filed: Nov. 24, 1997

Related U.S. Application Data

(63) Continuation of application No. 08/542,404, filed on Oct. 12, 1995, now abandoned.

(51) Int. Cl.[7] ..... E03D 9/00
(52) U.S. Cl. ..... 4/666
(58) Field of Search ..... 4/666, 253, 319, 4/340, 341; 68/181 D, 235 D

(56) References Cited

U.S. PATENT DOCUMENTS

| | | | | | |
|---|---|---|---|---|---|
| 1,459,713 | A | * | 6/1923 | Beggs | 4/319 |
| 1,795,376 | A | * | 3/1931 | Paul | 68/235 D |
| 2,568,857 | A | * | 9/1951 | Jacobs | 4/341 X |
| 2,882,708 | A | * | 4/1959 | Hancock et al. | 68/235 D |
| 3,048,854 | A | * | 8/1962 | Miller | 4/253 |
| 3,277,675 | A | * | 10/1966 | Scott | 68/181 D X |
| 3,318,119 | A | * | 5/1967 | Barks | 68/181 D X |
| 3,858,418 | A | * | 1/1975 | Butler | 4/666 X |
| 4,831,669 | A | * | 5/1989 | Edwards | 4/253 X |
| 5,042,523 | A | | 8/1991 | Robertson et al. | 137/271 |

OTHER PUBLICATIONS

Brochure entitled "New Product Submission" Copyright 1993.

Brochure entitled, "New Product Idea Available" Copyright 1993.

Concept Catalog, vol. XVII, Spring Edition, 1994, p. 135.

* cited by examiner

*Primary Examiner*—Robert M. Fetsuga
(74) *Attorney, Agent, or Firm*—Sughrue Mion, PLLC

(57) ABSTRACT

A bed linen and garment rinsing and laundering apparatus including a cabinet with an externally-controlled water supply and access to its interior by "dry box" gloves. The cabinet includes clear, waterproof material that forms a rectangular opening at the bottom surrounded by a flange and seal for positioning the apparatus on common fixtures such as toilets, service sinks/hoppers, and sewer drains. Internal to the cabinet is a shelf with holes separating the top and bottom portion and providing drainage and to prevent loss of garments to the lower portion of the cabinet and the drain and sewer below. A hinged door in both the top and bottom portions provides access to the interior for cleaning the cabinet interior and for placing soiled linens and garments on the shelf for rinsing and laundering. This arrangement reduces the risk and spread of disease to workers in healthcare facilities due to contact with human waste and body fluids containing blood-borne pathogens by confining the cleaning operations to a confined environment where all waste can be flushed to the sewage system below thereby to prevent intimate contact with the waste.

12 Claims, 5 Drawing Sheets

SELF-CONTAINED WASTE AND REFUSE DISPOSAL UNIT

This is a Continuation of application Ser. No. 08/542,404 filed Oct. 12, 1995 abandoned.

BACKGROUND OF THE INVENTION

1. Field of the Invention

This invention relates in general to laundering and in particular to laundering of linens and garments soiled by bed ridden persons such as those confined to nursing homes unable to tend for themselves.

2. Description of the Related Art

Bed ridden patients such as those confined to nursing homes or extended care facilities unable to control their bodily functions or use toilet facilities need their bed linens and garments laundered by workers of the facility. To launder the linens and prevent the spread of disease from intimate contact with the human waste workers by government regulation are required to wear protective equipment while rinsing or laundering these items. (Reference is directed to Federal Register/Vol. 56, No. 235/Friday Dec. 6, 1991/Rules and Regulations, Exposure Control Plan.) Normally, this operation is performed while bending over a toilet or hopper. This equipment includes gowns, hand and foot coverings, face shields, head covering, etc. which in turn need laundering or disposal if the equipment is single-use. In addition, regulations also require the disinfecting of the area once the laundering is completed. Wooten U.S. Pat. No. 4,748,700 addresses excrement created by animal kept as pets in the home through a toilet. Hancock, et al U.S. Pat. No. 2,882,708 and Russey U.S. Pat. No. 3,308,640 address the laundering of infant diapers using a toilet to dispose of infant excrement. Dickstein U.S. Pat. No. 4,285,076 cleans and flushes out ileostomy bags.

Due to the increased awareness of the spread of disease such as hepatitis and HIV virus, by blood-borne pathogens found in human waste and body fluids the need exists for a device that protects the healthcare worker from intimate contact with the waste, a means to reduce the contaminated waste created from protective equipment, and make the chore of rinsing soiled linens and garments less taxing on the healthcare worker since they are bending over a toilet or hopper to perform their duties.

Whatever the merits and advantages of the above sited references none of them has fulfilled the purposes of protecting the operator from intimate contact with the waste or provide the operator a comfortable position while performing their duties.

SUMMARY OF THE INVENTION

The principle object of the present invention is to provide a device for use in rinsing and laundering soiled bed linens and garments and disposing of the excrement contained in the soiled linens and garments.

It is also an object of the present invention to provide protection to the operator or healthcare worker from coming into intimate contact with the human waste and body fluids while rinsing and laundering the soiled linens and garments.

Another object is to provide such a device that is easily adaptable to common fixtures such as toilets and hoppers, available at institutions where this type of activity occurs (i.e. nursing homes, extended care facilities, etc.) and provide the operator or healthcare worker a comfortable height for safe and effective performance of their duties.

A further object is to reduce the spread of disease to the healthcare worker or operator from contact with blood-borne pathogens found in human waste and body fluids by containing the rinsing and laundering operation within a confined environment so the waste removed can be flushed into and out through the sewage system without intimate contact. The confined environment also will provide for less contaminated waste due to less protective equipment required by the operator.

An additional object of this invention is to prevent inadvertent loss of linens and garments into the sewage system along with the subsequent stoppage normally caused by items not intended to be flushed into the system.

The objects mentioned above can be accomplished by providing a self-contained, watertight laundering device adaptable to a toilet or hopper with an externally controlled water supply and access to the internal structure by so called "dry box" gloves. In the preferred embodiment of the invention, the self-contained, watertight container is formed by a plurality of clear, flat, waterproof sides with the pyramidal style sides forming a rectangular opening at the bottom which is surrounded by an adapting flange for positioning the device on the toilet or hopper. A hinged door with waterproof seal and an internal shelf in the upper portion of the device provides access and a staging area for the soiled linens and garments to perform the laundering operation and prevent the loss of the linens and garment into the toilet. Another door with a waterproof seal placed in the bottom portion of the device provides access for cleaning the device at prescribed intervals established by facility protocol. The upper portion of another side and at a height for operator comfort contains at least two so called "dry box" gloves for the operator to access the soiled linens internal to the device and manipulate them during the laundering process and maintaining a barrier between the worker and the laundering operation. The "dry box" gloves are waterproof and form a seal with openings in the upper portion of the side. External to the device, tubing is plumbed from existing facility plumbing to provide a source of water to a water mixing valve and detergent dispenser, both controllable by the operator. The tubing continues through a hole in one side of the device terminating internally at a flexible and operator manipulated spraying head above the location of the internal shelf in the upper portion of the device. The operator can place the soiled linens on the internal shelf and close the upper door which forms a waterproof seal with the side of the device. The operator then places their hands into the "dry box" gloves grasping the flexible spraying head with one hand and the soiled linens with the other activates the water mixing valve and detergent dispenser. This begins the process of rinsing and laundering the linens. The waste washed from the linens is allowed to fall through the holes in the shelf and out the bottom of the device to the toilet or hopper below. The waste is then flushed and disposed of into the sewage system. Since the device is self-contained and waterproof very little protective equipment is needed for protection of the operator. Cleaning and disinfecting the device is accomplished by washing the interior using the flexible spraying head and accessing the lower portion through the sealed door.

DETAILED DESCRIPTION OF THE INVENTION

Figure 1:
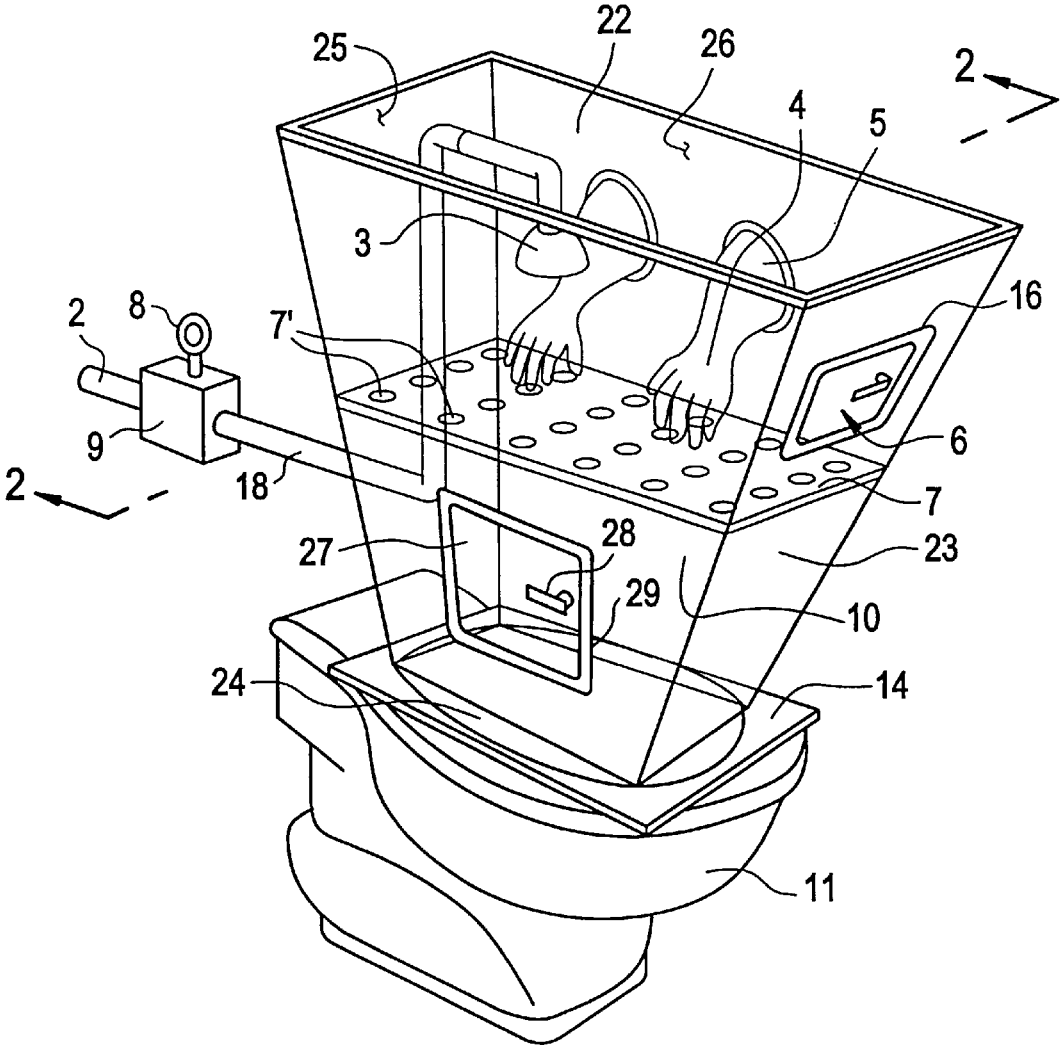
FIG. 1 is a perspective view showing the apparatus of the invention installed on a typical toilet with the "dry box" gloves removed for clarity, FIG. 2 section taken along line 2—2 of FIG. 1.

FIG. 1 shows a typical toilet 11 with the apparatus of the invention affixed over the bowl. The first components include two sides 10 and 26, a front side 23, a rear side 25, and a top side 22 all of a strong, clear material such as polycarbonate. One side 10 contains an access door 27 preferably for cleaning with a latch 28 for securing the access door 27 against a gasket 29 to provide a unique and waterproof seal with the side 10. The front side 23 contains another hinged access door 6 with a latch for securing access door 6 against a gasket 16 to provide a unique and waterproof seal with the front side 23.

When the front side 23, sides 10 and 26, and rear side 25 are joined at their edges by an appropriate means such as welding to provide a waterproof joint, their combination forms an inverted pyramidal cabinet. A top 22 is joined to the larger opening created by the combination of the sides by the same appropriate means forming a waterproof joint with the sides 10 and 26, front side 23, and rear side 25.

Tubing 2 connects the existing facility plumbing to a water mixing valve and detergent dispenser 9 controllable by the operator using a lever 8. Another length of tubing 18 continues from the valve 9 along a side of the device to a hole provided for ingress of the water source. The tubing 18 continues through the hole in the side and terminates at a flexible spray head 3 located directly above a shelf 7 in the upper interior portion of the device.

Figure 2:
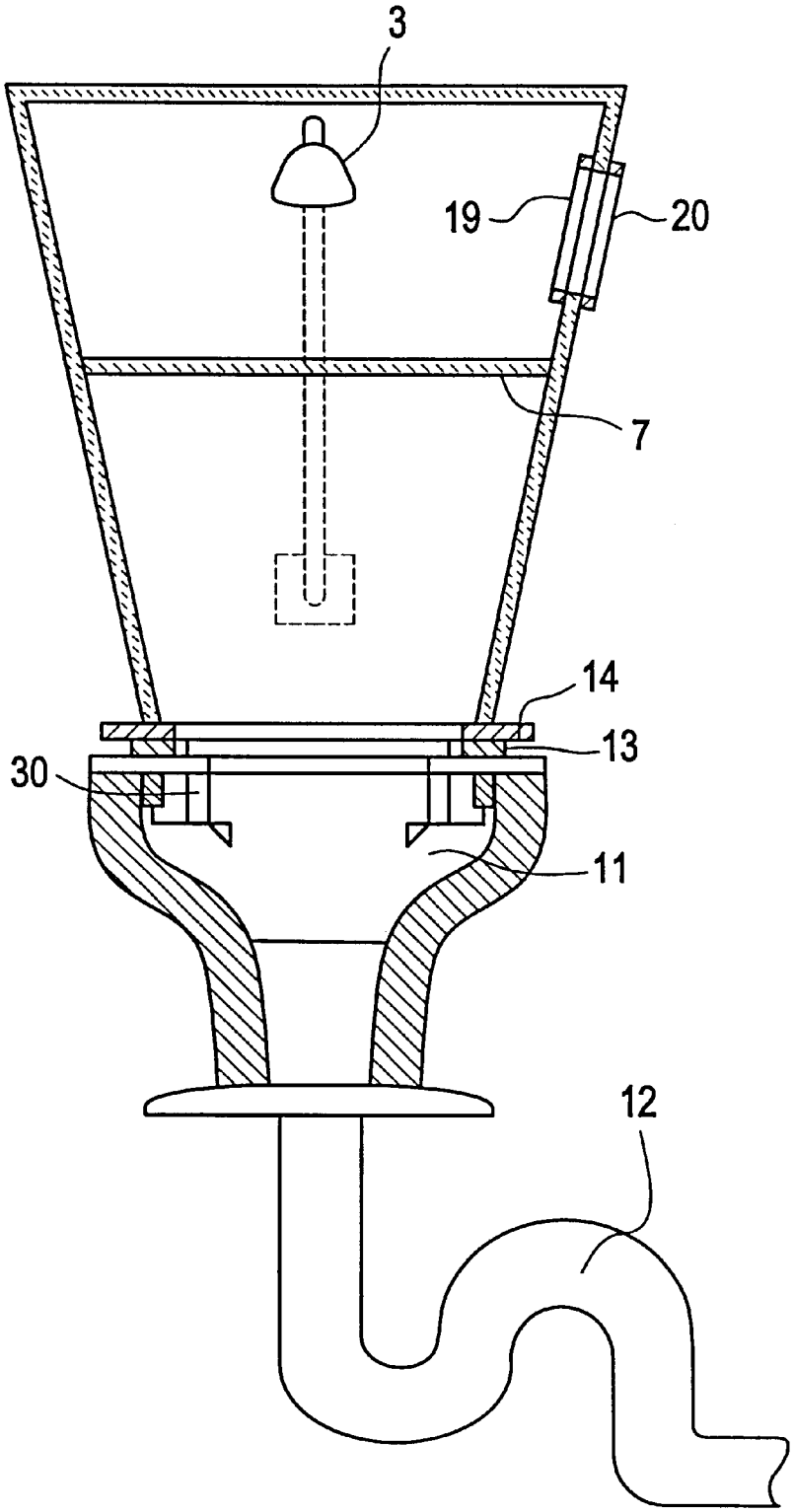

The opening 24 formed at the bottom of the union of the sides is surrounded by a toilet flange 14 appropriately joined by the same means as the top and sides. A seal 13, as seen in FIG. 2, is formed with the toilet 11 and the flange 14. FIG. 2 shows the location of the spray head 3 above the shelf 7 where the linens and garments are placed for rinsing and laundering. The waste, excess water, and detergent are washed through a plurality of through-holes 7' formed in the shelf 7 and allowed to pass into the toilet through the opening 24 in the bottom of the device where it can be flushed into the sewage system 12. Clamps 30 sufficiently spaced around the flange 14 and appropriately placed provide a method of securement to the rim of a toilet/hopper.

Figure 3:
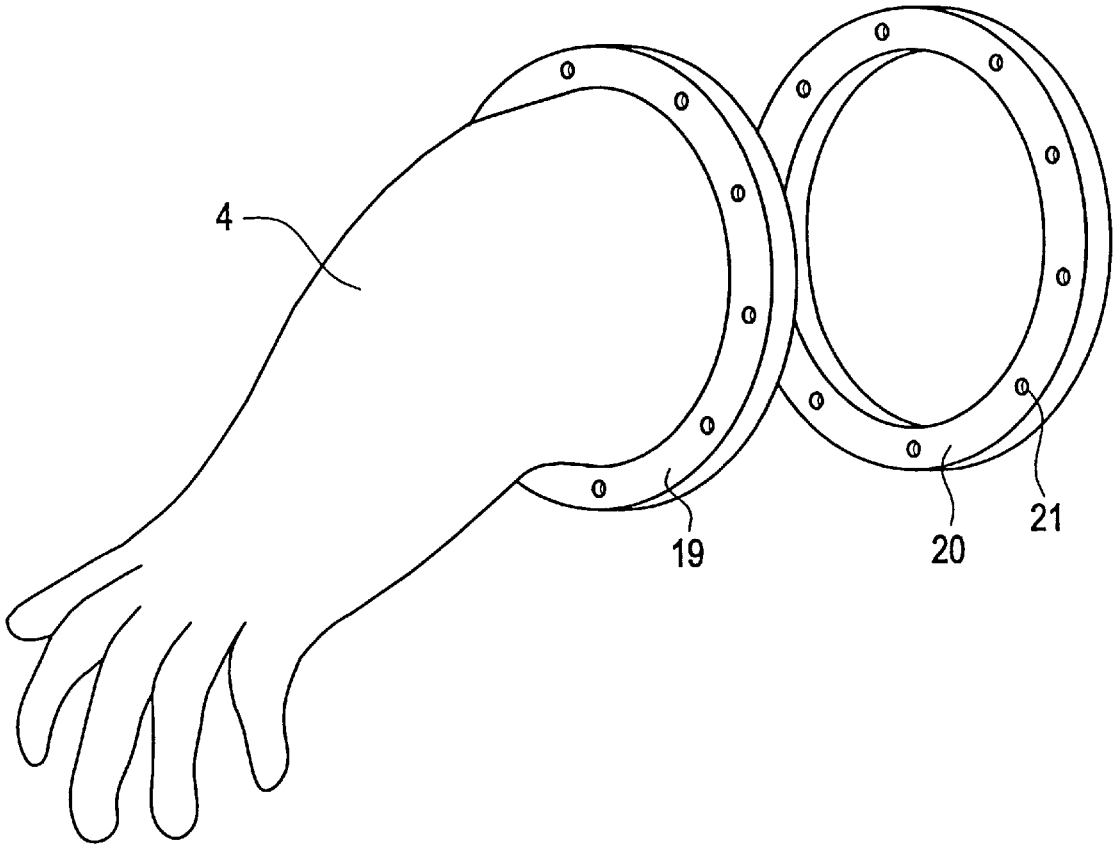
FIG. 3 shows one of the "dry box" gloves and the seal formed with one side of the apparatus.

FIG. 3 is an exploded view of one of the two so called "dry box" gloves 4 and the flanges 19 and 20 attached to an opening 5 in the upper portion of one side 26 by appropriate fasteners 21 possibly screws which in turn forms a waterproof seal.

Figure 4:
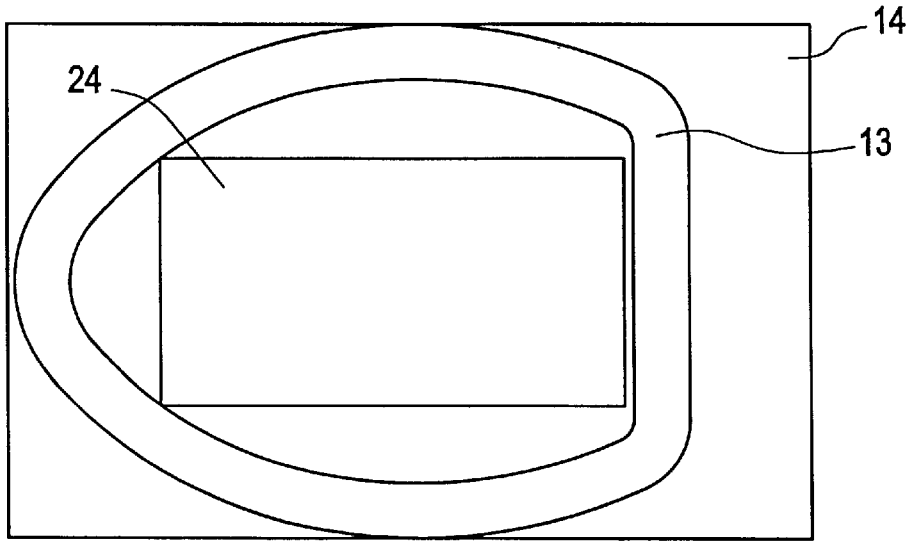
FIG. 4 depicts the base of the apparatus with the toilet seal installed.

FIG. 4 shows the opening 24 in the flange 14 and a typical seal 13 as it would be installed on a toilet.

Figure 5:
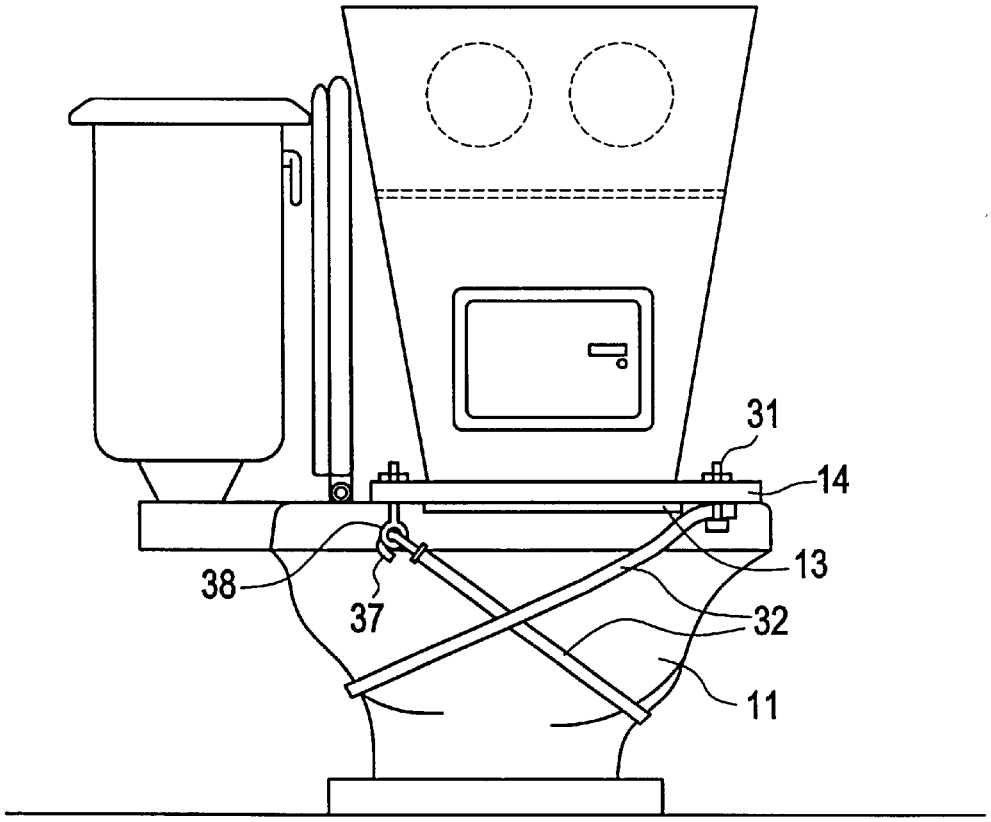
FIG. 5 shows the apparatus of the invention installed on a toilet using straps.

FIG. 5 shows the apparatus of the invention installed on a toilet 11 and held secure by a plurality of straps 32 at least two preferably of a rubber-like substance attached at one front side of the flange 14 by appropriate means such as an eye bolt and having a hook 37 on the opposite end stretched around, under, and upward about the toilet bowl to a hook receiver 38. The downward force exerted by the rubber-like straps 2 on the pyramidal cabinet allows the seal 13 compress against the toilet 11 rim to provide a water tight seal for the apparatus.

Figure 6:
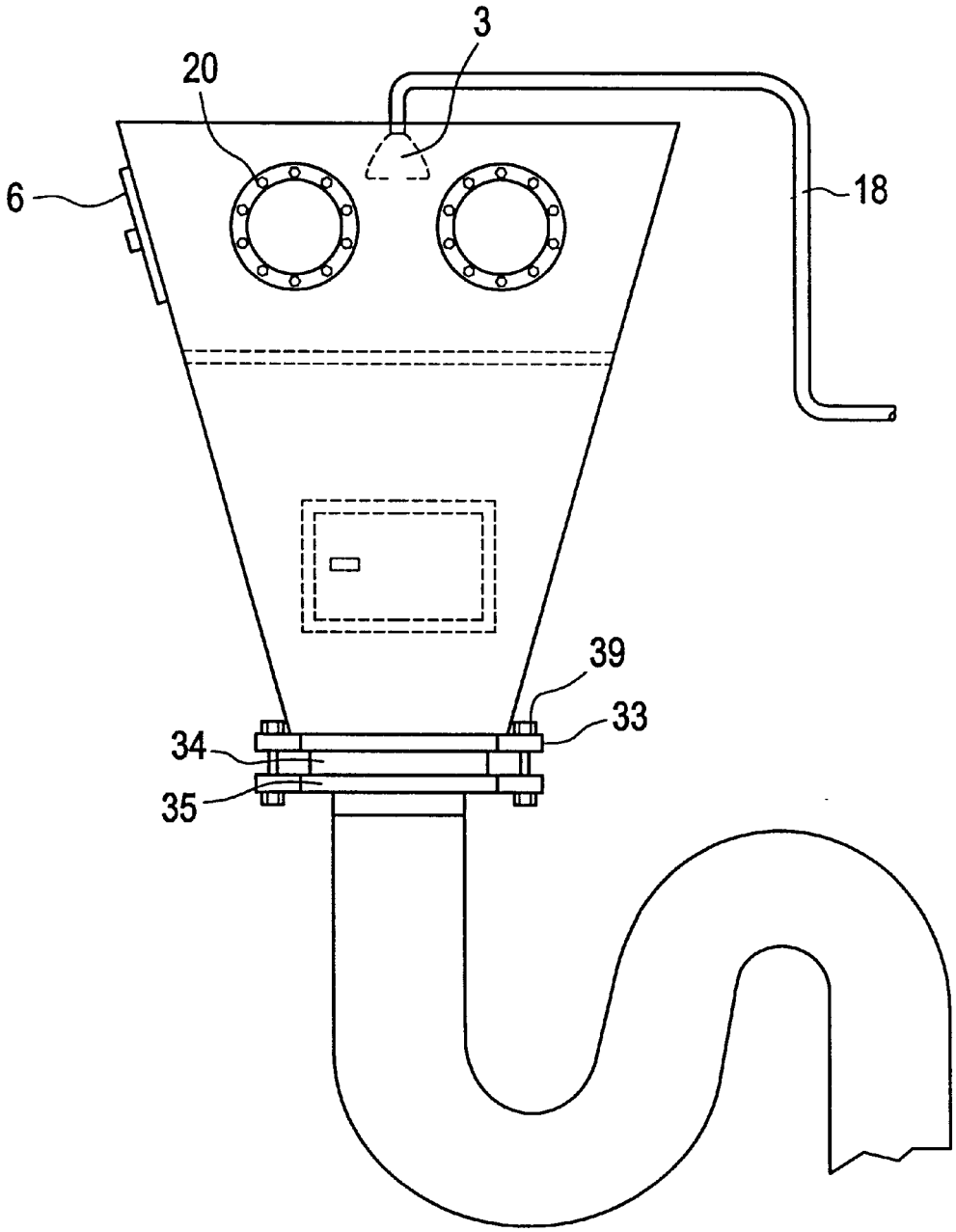
FIG. 6 shows the apparatus of the invention installed on a sewer drain pipe flange.

FIG. 6 shows the apparatus of the invention installed on a sewer drain pipe flange 35. The pyramidal cabinet is extended downward to a flange 33 of a like design of a standard so-called toilet flange. A seal 34 is compressed between flange 33 and sewer drain pipe flange 35 with appropriate fasteners 39 spaced sufficiently around the flange 33 and 35 to form a water tight seal.

The foregoing description of the preferred embodiment has been presented for the purpose of illustration and description. It is not intended to be exhaustive and variations are possible in light of the above teaching. It is intended that the scope of the invention be limited not by this detailed description, but rather by the claims appended hereto.

What is claimed is:

1. A self-contained linen and garment rinsing and laundering apparatus operative for installation on a toilet bowl, comprising: a closed top, open bottom cabinet having sides; means for joining said sides and top to form a watertight cabinet; said cabinet having a shelf which separates said cabinet internally into an enlarged, upper portion, which has an operator manipulated spray head disposed therein, and a lower portion, said shelf serving to hold linens and garments while rinsing and laundering; said shelf having through-holes to allow excrement to pass through to the toilet bowl below; an operator controlled mixing valve and detergent dispenser connected by a first tubing to a source of rinsing liquid, and a second tubing which connects said spray head to said mixing valve and detergent dispenser; at least one of said sides of said upper portion of said cabinet being transparent and having a pair of openings formed therein, and a waterproof glove sealingly mounted to each of said openings for allowing an operator sanitary, manual access to and attendant observation of said upper portion of said cabinet while the operator is in an upright posture during rinsing and laundering of the linens and garments.

2. The apparatus of claim 1, wherein said top, said sides, and said shelf are made of plastic.

3. The apparatus of claim 1, further comprising a flange for seating a bottom of said cabinet on a rim of the toilet bowl, and a first strap having one end attached to a hook receiver at one front side of said flange and an opposite end extending downward, under, and around the toilet bowl and then upward to an opposite rear side of said flange and attached to a hook receiver, and a second strap having one end attached to a hook receiver at an opposite front side of said flange and an opposite end extending downward, under, and around the toilet bowl and then upward to an opposite rear side of said flange to a hook receiver.

4. The apparatus of claim 1, wherein said cabinet has a substantially inverted pyramidal shape.

5. The apparatus of claim 2, wherein said plastic forming said top, said sides and said shelf is transparent.

6. The apparatus of claim 1, further comprising a hinged, watertight access door mounted in an opening formed in one of said sides of said upper portion of said cabinet.

7. The apparatus of claim 1, further comprising a hinged, watertight access door mounted in an opening formed in one of said sides of said lower portion of said cabinet.

8. A body substance isolation and rinsing apparatus operative for installation in an upright position on a toilet bowl, comprising:

a watertight cabinet having an enlarged upper portion and a lower portion, said lower portion having an open bottom;

a flange, disposed at said open bottom of said cabinet, for seating said cabinet to the toilet bowl;

an internal shelf mounted within said cabinet and separating said enlarged upper portion from said lower portion, said shelf serving to hold an item to be rinsed of a body substance and having a plurality of through-holes to allow the body substance to pass through to the toilet bowl;

an operator controlled mixing valve and detergent dispenser connected by a first tubing to a source of rinsing liquid;

an operator manipulated spray head connected by a second tubing to said mixing valve and detergent dispenser and communicated with said enlarged upper portion and for introducing the rinsing liquid into said cabinet; and a pair of openings formed in a side portion of said enlarged upper portion of said cabinet, with at least the side portion being transparent, and a waterproof glove sealingly mounted to each of said openings, said waterproof gloves being positioned on said cabinet at such a height to allow an operator sanitary, manual access into said enlarged upper portion of said cabinet and attendant viewing through the side portion while the operator is in an upright posture during rinsing of the item to be rinsed of the body substance.

9. The apparatus of claim 8, wherein said cabinet has a substantially inverted pyramidal shape.

10. The apparatus of claim 8, wherein the cabinet is formed of transparent plastic.

11. The apparatus of claim 8, further comprising a hinged, watertight access door mounted in an opening formed in said enlarged upper portion of said cabinet.

12. The apparatus of claim 8, further comprising a hinged, watertight access door mounted in an opening formed in said lower portion of said cabinet.

* * * * *

UNITED STATES PATENT AND TRADEMARK OFFICE

CERTIFICATE OF CORRECTION

PATENT NO. : 6,463,601 B1
DATED : October 15, 2002
INVENTOR(S) : Randy E. Fetty

It is certified that error appears in the above-identified patent and that said Letters Patent is hereby corrected as shown below:

Title page,
Item [*] Notice, delete "0", and insert -- 453 --

Signed and Sealed this

Twenty-sixth Day of August, 2003

JAMES E. ROGAN
*Director of the United States Patent and Trademark Office*